US005498353A

United States Patent [19]

Lin et al.

[11] Patent Number: 5,498,353

[45] Date of Patent: Mar. 12, 1996

[54] SEMI-SYNTHETIC TWO-STROKE ENGINE OIL FORMULATION

[75] Inventors: Ron-Sheng Lin; Chen-Yi Lin; Tsae-Shycm Lee; Chi-Chung Chen; Su-Terng Chang; Kuo-Min Wei, all of Chia-Yi, Taiwan

[73] Assignee: Chinese Petroleum Corp., Taiwan

[21] Appl. No.: 343,345

[22] Filed: Nov. 22, 1994

[51] Int. Cl.[6] ..... C10M 141/06; C10M 141/12

[52] U.S. Cl. ..... 252/33.4; 252/40.5; 252/49.6; 252/50; 252/51.5 A; 208/15; 208/19

[58] Field of Search ..... 252/33.4, 39, 49.6, 252/50, 51.5 A, 40.5; 208/15, 19, 11; 585/2

[56] References Cited

U.S. PATENT DOCUMENTS

| | | | |
|---|---|---|---|
| 3,807,976 | 4/1974 | Polss . | |
| 3,857,791 | 12/1974 | Marcellis et al. | 252/51.5 A |
| 4,100,082 | 7/1978 | Clason et al. | 252/33.4 |
| 4,200,545 | 4/1980 | Clason et al. | 252/33.4 |
| 4,419,252 | 12/1983 | Shim . | |
| 4,481,122 | 11/1984 | Root et al. . | |
| 4,663,063 | 5/1987 | Davis | 252/51.5 R |
| 4,708,809 | 11/1987 | Davis | 252/33.4 |
| 4,717,489 | 1/1988 | Schieman | 252/32.7 |
| 4,724,091 | 2/1988 | Davis | 252/33.4 |
| 4,740,321 | 4/1988 | Davis et al. | 252/33.4 |
| 4,820,432 | 4/1989 | Lundberg et al. . | |
| 4,873,004 | 10/1989 | Beverwijk et al. | 252/33.4 |
| 5,049,291 | 9/1991 | Miyaji et al. | 252/33 |
| 5,064,546 | 11/1991 | Dasai | 252/32.5 |
| 5,198,130 | 3/1993 | Schumacher et al. . | |
| 5,321,172 | 6/1994 | Alexander et al. . | |
| 5,330,667 | 7/1994 | Tiffany, III et al. . | |

OTHER PUBLICATIONS

"Lubricant Additives", Smalheer et al, The Lezius–Hiles Co., Ohio, pp. 2–5, 1967.

*Primary Examiner*—Margaret Medley
*Attorney, Agent, or Firm*—Helfgott & Karas

[57] ABSTRACT

A semi-synthetic two-stroke engine oil formulation which comprises a base oil consisting of a high-viscosity mineral oil, a medium-viscosity mineral oil, a solvent and a mixture of three polyisobutylenes with different molecular weights, and appropriate detergents and dispersants. This semi-synthetic two-stroke engine has both high lubricity and high detergency, and also meets the requirements of low smoke and low exhaust system blocking.

3 Claims, No Drawings

SEMI-SYNTHETIC TWO-STROKE ENGINE OIL FORMULATION

FIELD OF THE INVENTION

The present invention relates to a semi-synthetic two-stroke engine oil which has both excellent lubricity and detergency, and also meets the requirements of low smoke and low exhaust system blocking.

BACKGROUND OF THE INVENTION

Recent years in Taiwan area, the development of economy and the growth of national income lead to a rapid increase in the number of automobiles, since automobiles can be utilized for the purposes of commercial, industrial and leisure activities. The huge number of automobiles causes heavy traffic jams. Motorcycle is more moveable and easier to park, so it plays an important role in the medium- and short-distance transportation systems. In Taiwan area, the number of motorcycles with two-stroke engines is about 70% of the total number of motorcycles. A motorcycle with two-stroke engine is advantageous in that it has a simple engine structure, light weight, small volume, high engine output and easy maintenance. On the other hand, however, motorcycles with two-stroke engines cause the problem of serious air pollution due to their inlet and outlet system design. The result of investigation on contamination sources in Taiwan area reveals that 29% of the total carbon monoxide (CO) discharge and 20% of the total hydrocarbons discharge come from motorcycles with two-stroke engines. Therefore, in order to help solving the traffic jam problem, it is imperative to overcome the air pollution caused by motorcycles with two-stroke engines. For the purpose of efficient control of the air pollution by motorcycles, the Environmental Protection Administration in Taiwan promulgated the Second Stage Motorcycle Emmision Standard on 1991, which defines the upper limit of the total amount of hydrocarbons and $NO_x$ as 3.0 g/km and the upper limit of CO amount as 4.5 g/km. In order to meet the requirements in the abovesaid regulation, several big motorcycle manufacturers have aggressively made efforts to research and improve engine combustion and exhaust systems of motorcycles. Since July of 1992, all the two-stroke motorcycles from the OEM have to be equipped with catalytic converter to comply with the tight regulation.

In addition to the requirements in the respect of environmental protection, motorcycle manufacturers also keep on doing research and develop to enhance the engine performances of two-stroke motorcycles, thereby pushing lubricating oil manufacturers to provide products more fit to the updated requirements. A result directly caused by the requirements is that lubricating oils with better capability of protecting high-performance engines are needed.

The lubricating system for two-stroke engine is supplied by the mixture of two-stroke oil and fuel. Mixed gas passed from the intake port into the combustion chamber. The passing oils stick to the gas cylinder and piston is thus providing the necessary lubricity for the two-stroke engine. In order to prevent the deposit formed in the combustion chamber and piston, there is no traditional ash type additives (i.e., ZDDP) contained in the two-stroke oil formulation, so the lubricity is mainly contributed from the oil film of the base oil. A base oil may contain mineral and/or synthetic oils.

Adding a high molecular weight polyisobutylene (PIB) into an engine oil can enhance the oil's lubricity, but the carbon deposit may be increased and thus the oil's detergency is decreased. Since in principle detergency conflicts with lubricity, how to make a balance between them in order to obtain an optimum effect is still a problem not solved in the industry.

SUMMARY OF THE INVENTION

The present invention provides a new semi-synthetic two-stroke engine oil which comprises a base oil consisting of a high-viscosity mineral oil, a medium-viscosity mineral oil, a solvent and a mixture of three PIBs with different molecular weights, and appropriate detergents and dispersants. This semi-synthetic two-stroke engine oil has both high lubricity and high detergency, and also meets the requirements of low smoke and low exhaust system blocking.

DETAILED DESCRIPTIONS OF THE INVENTION

The components of the two-stroke engine oil of the present invention include mineral base oil, a PIB mixture, a solvent, detergents and a dispersants:

Unless particularly mentioned, the amount of the components of the two-stroke engine oil are expressed in weight percent.

The mineral base oil is composed of a high-viscosity mineral oil (HN) and a medium-viscosity mineral oil (MN). Based on the total weight of the two-stroke engine oil, the amount of the high-viscosity mineral oil is from about 0 to 20%, and the medium-viscosity mineral oil is from about 10 to 50%.

A suitable high-viscosity mineral oil is a paraffinic based oil which also comprises naphthenic and aromatic groups. This high-viscosity mineral oil has a specific gravity of about 0.9 at 15.6° C. measured by the method D1298, a viscosity of about 90–140 cSt at 40° C. and a viscosity of about 10–15 cSt at 100° C. measured by the method of D445, a flash point of about 250° C. and a pour point of less than −12° C. This mineral oil belongs to heavy neutral.

A suitable medium-viscosity mineral oil is a paraffinic based oil which also comprises naphthenic and aromatic groups. This medium-viscosity mineral oil has a specific gravity of about 0.9 at 15.6° C. measured by the method D1298, a viscosity of about 30– 50 cSt at 40° C. and a viscosity of about 4–8 cSt at 100° C. measured by the method D445, a flash point of about 220° C. and a pour point of less than −12° C. This mineral oil belongs to medium neutral.

A suitable solvent is one which has a flash point of higher than 100° F., a boiling point of lower than 570° F. and a distillation range from about 180° to 300° C. (360° to 572° F.). Based on the total weight of the two-stroke engine oil, the amount of the solvent is from about 5 to 30%.

A suitable mixture of PIBs is composed of three PIBs with different molecular weight. This mixture comprises, calculated on the total weight of the two-stroke engine oil, about 5–30% PIB A with a molecular weight of from 900 to 1000, about 5–30% PIB B with a molecular weight of from 400 to 500 and about 2–10% PIB C with a molecular weight of from 1200 to 1400. All of the said molecular weights refer to number average molecular weight ($\underline{Mn}$).

The detergent has at least one main ingredient selected from the groups consisting of phenates, salicylates, neutral or overbased petroleum sulphonates and synthetic sulphonates of alkaline earth metals. The dispersant has at least one main ingredient selected from the group consisting of mono-, bi- or boronated polybutene succinimides, borated or non-borated polybutene amines and polybutene succinimides. The total amount of the detergents and dispersants is about 2–12%.

The semi-synthetic two-stroke engine oil of the present invention can further comprises an antioxidant which can be a phenolic antioxidant (such as a hindered phenol) or an aminic antioxidant (such as an alkyl diphenylamine).

The preparation method of the semi-synthetic two-stroke engine oil of the present invention is as follows. Add the mineral base oil, i.e., the high-viscosity mineral oil and the medium-viscosity mineral oil, at room temperature into a vessel. Then add the solvent at room temperature while mixing. Add the detergents and dispersants having been preheated to 60°–70° C. while mixing. Finally, add a mixture of the three PIBs having been preheated to 60°–70° C. while mixing.

The present invention will be further illustrated by the following examples. However, it should be understood that the invention is not limited to the specific details of the examples.

EXAMPLES

The two-stroke engine oils of Examples 1–3 listed in the Table as below were prepared in accordance with the method described above, that is, the method comprising first adding the mineral base oil into a vessel, adding the solvent at room temperature while mixing, then adding the detergents and dispersants having been preheated to 60°–70° C. while mixing, and finally adding a mixture of the three PIBs having been preheated to 60°–70° C. while mixing.

In the Examples, the component A used includes MN (medium neutral) and/or HN (heavy neutral), wherein the medium neutral is 250 SN (Solvent Neutral) and the high neutral is 650 SN.

In the Examples, the component B used is a composition consisting of PIB A (Mn≈900), PIB B (Mn≈460) and PIB C (Mn≈1300).

The detergents and dispersants used in the Examples is a composition comprising phenate and sulphonate of calcium and polybutene succinimides.

The data of detergency, lubricity and smoke indexes in the above Table were measured by the procedures in JASO (Japanese Automobile Standard Organization) Activity on 2T E.O. Specification, in which JATRE-1 was used as the reference oil. The procedures are briefly described as follows:

(A) Lubricity

The lubricity of the engine oils is evaluated in terms of change in torque versus temperature using a 49.5 $cm^3$ displacement, single cylinder, air cooled two-stroke engine. The test should be run both on the reference oil and the candidate oil on the same date. A premixed fuel of gasoline and oil at the ratio of 50:1 should be used. Run the engine at 4000 rpm under the full load (adjusting CO concentration at 6.0+/–0.5%) and stop cooling air supply when stabilized. Output torque should be measured when the plug gasket temperature gets at 200° C. and 300° C. respectively. The initial torque index at 200° C. and the torque decrease index of the candidate oil are calculated by defining the measurements of the reference oil as 100.

(B) Detergency

The test should be run in a 49.5 $cm^3$ displacement, single cylinder, air cooled two-stroke engine for a specified period of time to evaluate ring sticking, piston deposits, and cylinder head deposits. The test should be run both on the reference oil and the candidate oil on the same date. A premixed fuel of gasoline and oil at the volume of 100:1 should be used. Each test consists of the break-in run at 6000 rpm for 10 minutes and the test run at 6000 rpm under the full load (CO concentration at 6.0+/–0.5%) for 60 minutes. Evaluate the detergency of the combustion chamber according to "The method to evaluate the detergency of 2 cycle gasoline engine" (JPI-5S-34-91).

(C) Smoke

Run the test of smoke formation on a SUZUKI 70 cc two-stroke engine fitted with a generator by using a premixed fuel of gasoline and oil at the Volume ratio of 10:1. Before running the test the exhaust pipe of the engine should be covered by a muffler made of glass wool. Operate the engine under a high load of 60 Hz/800 W, and heated by the engine exhaust to remove any remaining oil deposits from the exhaust pipe. The engine is then stopped and allowed to cool, in the meantime the muffler is removed. The engine is started and operated at 50 Hz/no load (0 W) for 20 minutes. Then the engine is loaded to 50 Hz/700 W and operated. The maximum exhaust smoke density is measured by a smoke meter. The smoke index of the candidate oil is calculated by defining the smoke index of the reference oil as 100.

TABLE

| Example No. | component A (%) MN | component A (%) HN | component B (%) PIB A | component B (%) PIB B | component B (%) PIB C | solvent (%) (kerosene) | detergents and dispersants (%) | vicosity (cSt) at 100° C. | detergency index (JASO FC standard being at least 95) | lubricity index (JASO FC standard being at least 95) |
|---|---|---|---|---|---|---|---|---|---|---|
| 1 | 41.5 | 7 | 10 | 15 | 5 | 16.3 | 5.2 | 8.2 | 105 | 96 |
| 2 | 27.5 | 0 | 19 | 19 | 7 | 20.5 | 7 | 8.6 | 132 | 102 |
| 3 | 13 | 0 | 23 | 23 | 9 | 25 | 7 | 8.7 | 112 | 102 |

In addition, the two-stroke engine oil of Example 2 has a smoke index of 104 and has an initial torque of 98 measured by the lubricity test (the JASO FC standard being at least 98).

We claim:

1. A semi-synthetic two-stroke engine oil comprising the following components:

a mineral base oil selected from the group consisting of a medium-viscosity mineral oil (MN) having a viscosity of about 4–8 cSt at 100° C., a high-viscosity mineral oil (HN) having a viscosity of about 10–15 cSt at 100° C., and a mixture of said medium-viscosity mineral oil and said high-viscosity mineral oil;

wherein the amount of the high-viscosity mineral oil is from about 0 to 20% and the medium-viscosity mineral oil is from about 10 to 50%.

5–30% by weight of kerosene as the solvent;

2–12% by weight of detergents and dispersants; and a mixture of three polyisobutylenes comprising, based on the total weight of the two-stroke engine oil, 5–30% by weight of a first polyisobutylene with a molecular weight of from 900 to 1000, 5–30% by weight of a second polyisobutylene with a molecular weight of from 400 to 500 and 2–10% by weight of a third polyisobutylene with a molecular weight of from 1200 to 1400.

2. The two-stroke engine oil according to claim 1, wherein the detergents have at least one main ingredient selected from the group consisting of phenates, salicylates, neutral or overbased petroleum sulphonates and synthetic sulphonates of alkaline earth metals.

3. The two-stroke engine oil according to claim 1, wherein the dispersants have at least one main ingredient selected from the group consisting of mono, di or boronated polybutene succinimides, borated polybutene amines, non-borated polybutene amines and polybutene succinimides.

* * * * *